United States Patent [19]

Satake

[11] Patent Number: 4,829,893

[45] Date of Patent: May 16, 1989

[54] CEREAL-GRAIN POLISHING APPARATUS

[75] Inventor: Toshihiko Satake, Higashihiroshima, Japan

[73] Assignee: Satake Engineering Co., Ltd., Tokyo, Japan

[21] Appl. No.: 228,044

[22] Filed: Aug. 4, 1988

[51] Int. Cl.[4] ..... B02B 3/00; B02B 7/02

[52] U.S. Cl. ..... 99/603; 99/519; 99/524; 99/608; 99/611

[58] Field of Search ..... 99/518, 519, 522, 524, 99/488, 525, 528, 600–603, 605, 607, 608, 609–611, 617, 620, 622; 426/482, 483; 241/7, 73, 245

[56] References Cited

U.S. PATENT DOCUMENTS

| | | | |
|---|---|---|---|
| 3,628,582 | 12/1971 | Satake | 99/617 |
| 4,292,890 | 10/1981 | Satake . | |
| 4,323,006 | 4/1982 | Satake | 99/519 |
| 4,357,864 | 11/1982 | Salete-Garces | 99/609 X |
| 4,426,922 | 1/1984 | Yamamoto | 99/524 X |
| 4,459,903 | 7/1984 | Yamamoto | 99/528 X |
| 4,583,455 | 4/1986 | Salete-Garces | 99/617 X |

*Primary Examiner*—Timothy F. Simone

*Attorney, Agent, or Firm*—Wegner & Bretschneider

[57] ABSTRACT

In a cereal-grain polishing apparatus, a perforated tubular member is arranged substantially vertically. A polishing roll fixedly mounted to a rotary shaft is rotatably arranged within the perforated tubular member to define therebetween a polishing chamber. The polishing roll is provided with at least one agitating projection and at least one opening. Cereal grains to be polished are fed to the polishing chamber by a screw feed roll fixedly mounted to the rotary shaft, such that the cereal grains move upwardly through the polishing chamber. When the polishing roll is rotated, the agitating projection brings the cereal grains into friction contact with each other to remove surface layers from the respective cereal grains. Air is caused to flow from a hollow space within the polishing roll to a surrounding space around the perforated tubular member through the opening, the polishing chamber and perforations in the perforated tubular member, to carry the removed surface layers out of the polishing chamber to the surrounding space. The opening in the polishing roll is formed by a plurality of apertures smaller in size than the cereal grains to prevent the same from entering the hollow space from the polishing chamber.

14 Claims, 6 Drawing Sheets

CEREAL-GRAIN POLISHING APPARATUS

BACKGROUND OF THE INVENTION

The present invention relates to a cereal-grain polishing apparatus of vertical type in which cereal grains are polished during upward movement thereof through a polishing chamber defined between a perforated tubular member and a so-called friction-type polishing roll.

A cereal-grain polishing apparatus of the kind referred to above is known from, for example, Japanese Patent Application Laid-Open No. 63-7849 filed in the name of the assignee of this application. In the known apparatus, a perforated tubular member is arranged substantially vertically. A polishing roll fixedly mounted to a rotary shaft is rotatably arranged within the perforated tubular member to define a polishing chamber between a peripheral wall of the polishing roll and the perforated tubular member. The peripheral wall of the polishing roll cooperates with a peripheral surface of the rotary shaft to define therebetween a hollow space. The polishing roll is provided with at least one vertically extending, elongated agitating projection and at least one vertically extending, elongated opening communicating with the hollow space. Cereal grains to be polished are forcibly supplied to a supply position below a lower end of the polishing chamber. A screw feed roll is fixedly mounted to the rotary shaft at a location below the polishing roll, for feeding cereal grains to the polishing chamber from the supply position. Thus, the cereal grains are caused to move upwardly through the polishing chamber.

In operation, when the polishing roll is rotated, the agitating projection on the polishing roll brings the cereal grains within the polishing chamber, into friction contact with each other to remove surface layers from the respective cereal grains, thereby polishing the same. Air is caused to flow from the hollow space between the rotary shaft and the polishing roll, to a surrounding space around the perforated tubular member through the elongated opening in the polishing roll, the polishing chamber and the perforations in the perforated tubular member, to carry the removed surface layers of cereal grains out of the polishing chamber to the surrounding space.

The cereal-grain polishing apparatus described above is excellent in that because the cereal grains are forcibly supplied to the supply position, an amount of cereal grains fed to the polishing chamber is stabilized, making it possible to avoid lack of uniformity in polishing of the cereal grains due to insufficient supply thereof to the polishing chamber.

However, the conventional cereal-grain polishing apparatus yet leaves room for further improvement. That is, there is a possibility that during polishing of the cereal grains within the polishing chamber, some cereal grains enter the hollow space within the polishing roll from the polishing chamber through the elongated opening, and are accumulated on the bottom of the hollow space. The accumulated cereal grains sometimes cause eccentric rotation of the polishing roll, resulting in non-uniform polishing of the cereal grains. Moreover, during polishing of cereal grains of a different variety, the previously accumulated cereal grains are returned to the polishing chamber through the elongated opening and are mixed with the cereal grains of the different variety. For instance, nonglutinous rice is mixed with glutinous rice.

SUMMARY OF THE INVENTION

It is an object of the invention to provide a cereal-grain polishing apparatus capable of preventing cereal grains from entering the hollow space between the peripheral wall of the polishing roll and the rotary shaft, during polishing of the cereal grains.

It is another object of the invention to provide a cereal-grain polishing apparatus capable of achieving the above object, and capable of easily and quickly discharging residual cereal grains within the apparatus after completion of the polishing operation.

It is still another object of the invention to provide a cereal-grain polishing apparatus capable of achieving the first-mentioned object, and capable of facilitating replacement o the polishing roll and the screw feed roll with new or another ones.

According to the invention, there is provided a cereal-grain polishing apparatus comprising:

a perforated tubular member arranged to have an axis extending substantially vertically;

a rotary shaft rotatably arranged within the perforated tubular member and having an axis substantially coincident with the axis of the perforated tubular member;

drive means for rotatively driving the rotary shaft;

a polishing roll arranged within the perforated tubular member and mounted on the rotary shaft for rotation therewith, the polishing roll having a peripheral wall extending in substantially concentric relation to the axis of the rotary shaft, the peripheral wall having an outer surface which cooperates with the perforated tubular member to define therebetween a polishing chamber, the peripheral wall having an inner surface which cooperates with an outer peripheral surface of the rotary shaft to define therebetween a hollow space, the polishing roll being provided in the peripheral wall with opening means through which the hollow space communicates with the polishing chamber, the polishing roll being further provided on the peripheral wall with agitating projection means projecting from the outer surface of the peripheral wall;

a screw feed roll mounted on the rotary shaft for rotation therewith, at a location below the polishing roll;

supply means for forcibly supplying cereal grains to be polished, to a supply position at the screw feed roll, wherein when the polishing roll and the screw feed roll are rotated together with the rotary shaft by the drive means, the screw feed roll feeds the cereal grains supplied to the supply position by the supply means, into the polishing chamber thereby causing the cereal grains to move upwardly toward an upper end of the polishing chamber through the same, and the agitating projection means on the polishing roll agitates the cereal grains within the polishing chamber to bring the cereal grains into friction contact with each other, thereby removing surface layers from the respective cereal grains to polish the same; and air-flow means for causing air to flow from the hollow space to a surrounding space around an outer peripheral surface of the perforated tubular member, through the opening means, the polishing chamber and perforations in the perforated tubular member, to carry the removed surface layers out of the polishing chamber to the surrounding space, wherein the opening means in the polishing roll is formed by a plurality of apertures smaller in size than the cereal grains to prevent the same from entering the hollow space from the polishing chamber.

According to the invention, there is also provided the above cereal-grain polishing apparatus which further comprises an imperforated tubular member arranged in coaxial relation to the perforated tubular member and having an upper end connected to a lower end of the perforate tubular member, the screw feed roll being arranged substantially within the imperforated tubular member, the imperforated tubular member being formed in its peripheral wall with a supply port, the supply means supplying the cereal grains to be polished, to the supply position through the supply port, and discharge means for discharging residual cereal grains within the imperforated tubular member after completion of the polishing operation, the discharge means including a rotary disc mounted, adjacent a lower end of the screw feed roll, on the rotary shaft for rotation therewith, a discharge port formed in the peripheral wall of the imperforated tubular member at a level of the rotary disc, a duct having one end thereof connected to the discharge port, a blower connected to the other end of the duct for drawing air therethrough, and valve means movable between a closed position where the valve means closes the discharge port and an open position where the valve means opens the discharge port.

According to the invention, there is further provided the first-mentioned cereal-grain polishing apparatus in which the screw feed roll can be divided into a plurality of sections each extending along an axis of the screw feed roll, and wherein the polishing roll can be divided into a plurality of sections each extending along an axis of the polishing roll.

DETAILED DESCRIPTION

Figure 1:
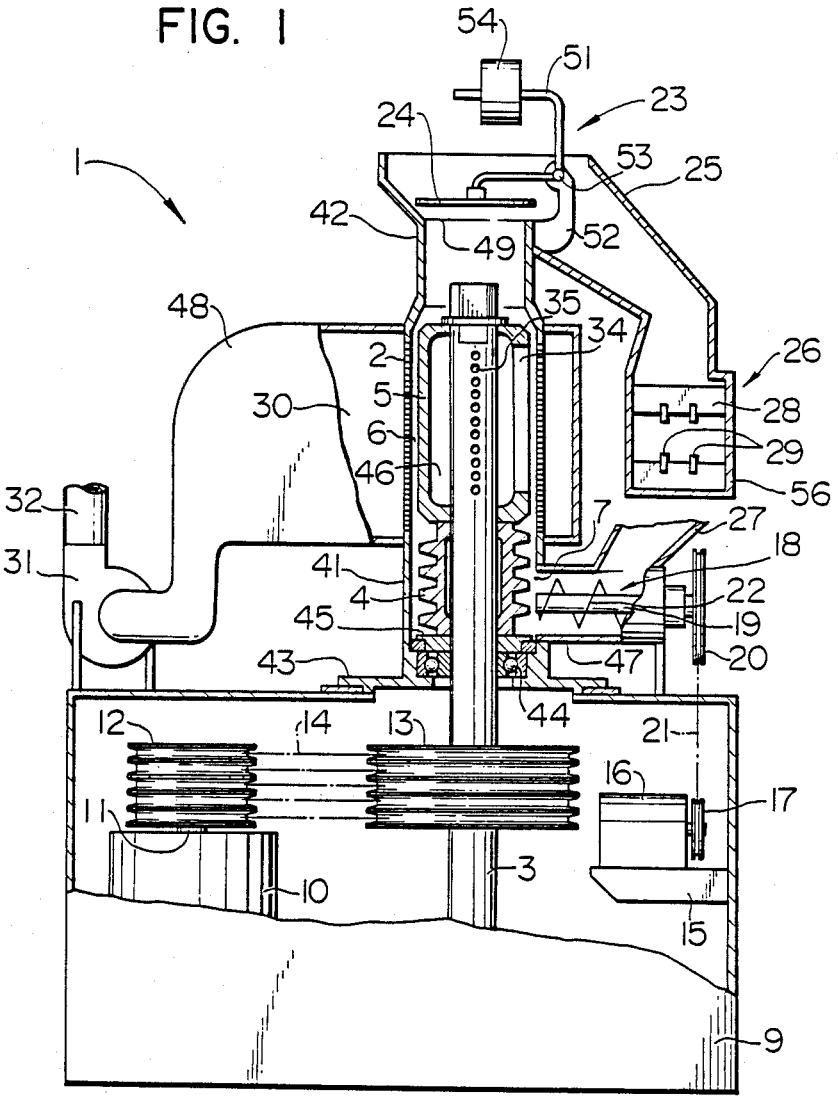
FIG. 1 is a partially broken-away side elevational view of a cereal-grain polishing apparatus according to a first embodiment of the invention.
Figure 2:
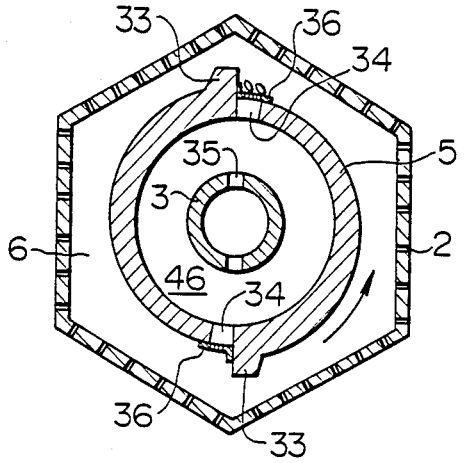
FIG. 2 is an enlarged, horizontal cross-sectional view of a perforated tubular member and a polishing roll which are incorporated in the apparatus illustrated in FIG. 1.
Figure 3:
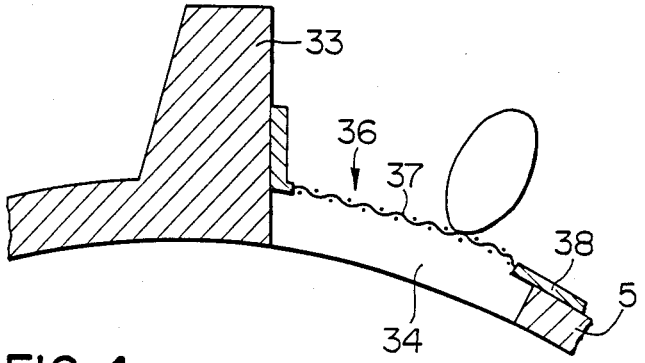
FIG. 3 is a further enlarged, fragmental cross-sectional view showing one of a pair of net members mounted to the polishing roll to respectively cover elongated slots in the polishing roll.

Referring first to FIGS. 1 through 3, there is shown a cereal-grain polishing apparatus, generally designated by the reference numeral 1, according to a first embodiment of the invention. The apparatus 1 comprises a perforated tubular member 2 arranged to have an axis extending substantially vertically. In the illustrated embodiment, the perforated tubular member 2 has a hexagonal cross-sectional shape as shown in FIG. 2. Perforations in the perforated tubular member 2 ar smaller in size than cereal grains to be polished, but are shown in FIG. 2 in an exaggerated manner. A lower imperforated tubular member 41 is arranged in coaxial relation to the perforated tubular member 2 and has an upper end connected to a lower end of the perforated tubular member 2. The lower imperforated tubular member 41 has a lower end which is substantially closed. The lower imperforated tubular member 41 is provided at its lower end with an end flange 43 extending radially outwardly, which is fixedly mounted to a top wall of a box-shaped base frame 9 by means of bolts (not shown). An upper imperforated tubular member 42 is arranged in coaxial relation to the perforated tubular member 2 and has a lower end connected to an upper end of the perforated tubular member 2. The perforated tubular member 2 and the lower and upper imperforated tubular members 41 and 42 may be formed integrally with each other or separately from each other.

A hollow rotary shaft 3 is arranged within the perforated tubular member 2 and the lower imperforated tubular member 41 in concentric relation thereto. The rotary shaft 3 extends downwardly through the lower closed end of the imperforated tubular member 41. The rotary shaft 3 is rotatably supported by a bearing 44 at the lower closed end of the imperforated tubular member 41 and a bearing (not shown) at a lower end of the rotary shaft 3. An upper end of the rotary shaft 3 is closed, while the lower end of the rotary shaft 3 is open to communicate with the environment. A plurality of through bores 35 are formed in the peripheral wall of an upper portion of the rotary shaft 3 which is surrounded by the perforated tubular member 2. The through bores 35 are spaced from each other along the axis of the rotary shaft 3.

A main electric motor 10 is arranged within the base frame 9. A pulley assembly 12 is mounted to an output shaft 11 of the motor 10 for rotation therewith. Another pulley assembly 13 is mounted to the lower portion of the rotary shaft 3 for rotation therewith, and is connected to the pulley assembly 12 through a belt assembly 14. When the motor 10 is turned on, rotation of the motor 10 is transmitted to the rotary shaft 3 through the pulley assembly 12, the belt assembly 14 and the pulley assembly 13, thereby rotatively driving the rotary shaft 3.

A polishing roll 5 is arranged within the perforated tubular member 2 and is mounted to the rotary shaft 3 for rotation therewith. The polishing roll 5 has a peripheral wall which extends in substantially concentric relation to the axis of the rotary shaft 3. The peripheral wall of the polishing roll 5 surrounds the upper portion of the rotary shaft 3 which is formed with the through bores 35. The peripheral wall of the polishing roll 5 has an outer surface which cooperates with the perforated tubular member 2 to define therebetween a polishing chamber 6. An inner surface of the peripheral wall of the polishing roll 5 cooperates with the peripheral surface of the rotary shaft 3 to define therebetween an annular hollow space 46 which communicates with the hollow portion of the rotary shaft 3 through the through bores 35.

The polishing roll 5 is of so-called friction type which is provided on the peripheral wall with a pair of vertically extending, elongated agitating projections 33 and 33 which project radially outwardly, as clearly shown in FIG. 2. The pair of elongated agitating projections 33 and 33 are arranged in diametrically opposed relation to each other. The polishing roll 5 is further provided in the peripheral wall with a pair of vertically extending, elongated slots 34 and 34 arranged in diametrically opposed relation to each other. The polishing chamber 6 communicates with the hollow space 46 through the elongated slots 34 and 34. The elongated slots 34 and 34 are located respectively just behind the elongated agitating projections 33 and 33 with reference to the rotational direction of the polishing roll 5 as indicated by an arrow in FIG. 2. The polishing roll 5 has substantially closed upper and lower end walls through which the rotary shaft 3 extends.

The lower imperforated tubular member 41 is formed in its peripheral wall with a supply port 7. A screw conveyor 18 is arranged at the supply port 7, for forcibly supplying cereal grains to be polished, such as rice grains, wheat grains or the like, to a supply position within the imperforated tubular member 41. The screw conveyor 18 comprises a cylindrical casing 47, a conveyor shaft 19 arranged within the casing 47 and having an axis extending horizontally, and a helical flight 22 mounted to the conveyor shaft 19. A supply hopper 27 is connected to a portion of the casing 47 remote from the supply port 7. The conveyor shaft 19 has an end portion projecting out of the casing 47 through a closed end wall thereof. A pulley 20 is mounted on the projecting end portion of the conveyor shaft 19 for rotation therewith. The pulley 20 is connected to a pulley 77 through a belt 21. The pulley 17 is fixedly mounted to an output shaft of an electric motor 16. The motor 16 is supported on a bracket 15 which is fixedly mounted to the side wall of the base frame 9.

A screw feed roll 4 is mounted on the rotary shaft 3 for rotation therewith. The screw feed roll 4 is arranged below the polishing roll 5 in coaxial relation to the same. The screw feed roll 4 is determined in axial position by a rotary disc 45 which is mounted on the rotary shaft 3 for rotation therewith. The rotary disc 45 is located substantially at a level of the lower edge of the supply port 7. When rotated, the screw feed roll 4 feeds the cereal grains supplied to the supply position by the screw conveyor 18 through the supply port 7, into the polishing chamber 6. Thus, the cereal grains are caused to move upwardly toward the upper end of the polishing chamber 6 through the same.

The arrangement is such that when the polishing roll 5 is rotated together with the rotary shaft 3 by the motor 10, the elongated agitating projections 33 and 33 on the polishing roll 5 agitate the cereal grains within the polishing chamber 6 to bring the cereal grains into friction contact with each other, thereby removing surface layers from the respective cereal grains to polish the same.

A duct assembly 48 is provided which has one end surrounding the perforated tubular member 2 to define therebetween a surrounding space 30 around the outer peripheral surface of the perforated tubular member 2. A blower 31 is connected to the other end of the duct assembly 48 for drawing air out of the same. A dust collecting pipe 32 has one end thereof which is connected to a discharge port of the blower 31. The other end of the dust collecting pipe 32 is connected to a dust collecting unit such as a cyclone (not shown) or the like. When the blower 31 is operated, air is caused to flow from the hollow portion of the rotary shaft 3 to the dust collecting pipe 32, through the through bores 35, the hollow space 46, the elongated slots 34, the polishing chamber 6 the perforations in the perforated tubular member 2, and the surrounding space 30, thereby carrying a dust including the removed surface layers, out of the polishing chamber 6 to the dust collecting pipe 32.

As clearly shown in FIGS. 2 and 3, the polishing roll 5 has a pair of elongated net members 36 and 36 serving as parts of the peripheral wall of the polishing roll 5. The net members 36 and 36 are mounted to the peripheral wall of the polishing roll 5 to respectively cover the elongated slots 34 and 34. Each of the net members 36 is composed of a frame 38 having a rectangular opening, and a wire net 37 with which the rectangular opening in the frame 38 is covered. The wire net 37 has a plurality of apertures or meshes of a size smaller than the cereal grains so that the wire net 37 permits air to flow therethrough, but prevents the cereal grains from entering the hollow space 46 from the polishing chamber 6 through the elongated slot 34. The frame 38 has opposite side edges which are fixedly mounted to the peripheral wall of the polishing roll 5 by means of screws (not shown).

The upper imperforated tubular member 42 defines a discharge port 49 for the polished cereal grains. Associated with the discharge port 49 is a polishing-degree adjusting mechanism generally designated by the reference numeral 23. The polishing-degree adjusting mechanism 23 comprises a pressure plate 24 capable of regulating pressure acting upon the cereal grains within the polishing chamber 6. The pressure plate 24 is connected to one of a pair of legs of a generally U-shaped lever 51 which is mounted to an upper end of a bracket 52 for pivotal movement about an axis of a pivot 53. The bracket 52 has a lower end which is fixedly mounted to the upper end of the upper imperforated tubular member 42. A weight 54 is mounted on the other leg of the lever 51, for adjusting the pressure exerted upon the cereal grains within the polishing chamber 6 by the pressure plate 24.

A discharge chute 25 has an upper end which is connected to the discharge port 49. A lower end of the discharge chute 25 is connected to a casing 56 of a scraper conveyor 26. The scraper conveyor 26 comprises a pair of chains 29 and 29 which run about a pair of spaced sprocket wheels (not shown), and a plurality of scrapers 28 attached to the chains 29 and 29 in equidistantly spaced relation to each other.

The operation of the cereal-grain polishing apparatus 1 constructed as above will be described below.

Cereal grains to be polished are supplied to the screw conveyor 18 through the supply hopper 27. As the main motor 10 for rotatively driving the rotary shaft 3 and the motor 16 for driving the screw conveyor are turned on, the cereal grains are forcibly transported by the rotating helical flight 22 of the screw conveyor 18 to the supply position between the screw feed roll 4 and the lower imperforated tubular member 41, through the supply port 7. The cereal grains transported to the supply position are fed by the rotating screw feed roll 4 upwardly toward the polishing chamber 6.

The cereal grains fed into the polishing chamber 6 are agitated by the elongated agitating projections 33 of the rotating polishing roll 5, while the cereal grains move upwardly through the polishing chamber 6. Thus, the cereal grains are brought into friction contact with each other so that surface layers are removed from the respective cereal grains. In this manner, the cereal grains are polished. The polished cereal grains are discharged through the discharge port 49 while being subjected to pressure due to the pressure plate 24 of the polishing-degree adjusting mechanism 23. Alternation in position of the weight 54 or replacement thereof by another one enables the pressure acting upon the cereal grains due to the pressure plate 24, to be regulated thereby adjusting the polishing degree of the cereal grains within the polishing chamber 6 due to the agitating action of the elongated agitating projections 33. The thus polished cereal grains flow through the discharge chute 25 and are conveyed to a subsequent processing step by the scraper conveyor 26.

During polishing of the cereal grains by the polishing roll 5, the cereal grains tend to enter the hollow space 46 within the polishing roll 5 through the elongated slots 34. However, the net members 36 mounted to the polishing roll 5 to respectively cover the elongated slots 34 effectively prevent the cereal grains from entering the hollow space 46 through the elongated slots 34. As discussed previously in the background of the invention of this specification, should such net members 36 be not provided, some cereal grains would enter the hollow space 46 from the polishing chamber 6 through the elongated slots 34, and would be accumulated on the bottom of the hollow space 46 within the polishing roll 5. The accumulated cereal grains cause eccentric rotation of the polishing roll 5, resulting in non-uniform polishing of the cereal grains. Moreover, during polishing of cereal grains of a different variety, the previously accumulated cereal grains are returned to the polishing chamber 6 through the elongated slots 34 and are mixed with the cereal grains of the different variety. The net members 36 can effectively avoid these inconveniences.

Air is caused to flow, by the blower 31, from the hollow portion of the rotary shaft 3 to the surrounding space 30 through the through bores 35, the elongated slots 34, the meshes of the net members 36, the polishing chamber 6, and the perforations in the perforated tubular member 2. The hollow space 46 is brought to a state of static pressure by virtue of the net members 36. This makes it possible for air to be blown from the hollow space 46 into the polishing chamber 6 through the meshes of the net members 36 uniformly along the elongated slots 34.

The air flow caused by the blower 31 carries the dust including the removed surface layers of the cereal grains and the like resulting from the polishing action within the polishing chamber 6, out of the same into the surrounding space 30. The dust within the surrounding space 30 is delivered to the dust collecting unit through the dust collecting pipe 32.

Figure 4:
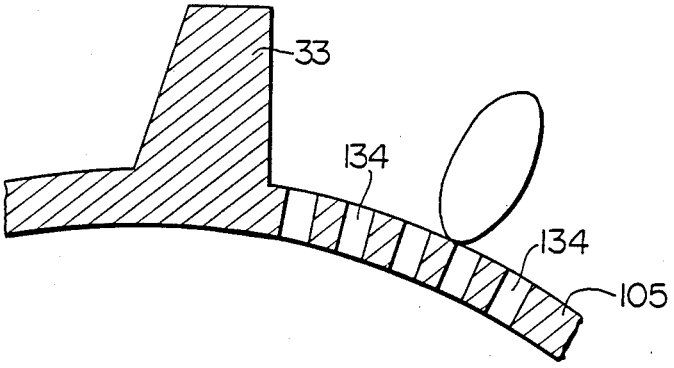
FIG. 4 is a view similar to FIG. 3, but showing a modification of the polishing roll.

FIG. 4 shows a modification of the polishing roll illustrated in FIGS. 2 and 3. The polishing roll 105 according to the modification is formed in its peripheral wall with a plurality of apertures or perforations 134. The perforations 134 are provided in a pair of vertically extending, elongated regions of the peripheral wall of the polishing roll 105. The regions correspond respectively to the elongated slots 34 in the peripheral wall of the polishing roll 5 described previously with reference to FIGS. 2 and 3. The perforations 134 in the polishing roll 105 are substantially the same in function as the meshes of the net members 36 illustrated in FIGS. 2 and 3.

As described above, the first embodiment and the modification illustrated respectively in FIGS. 1 through 3 and FIG. 4 are advantageous in the following points. That is, the net members 36 or the perforations 134 can effectively prevent the cereal grains from entering the hollow space 46 from the polishing chamber 6. This makes it possible to avoid that the cereal grains accumulated on the bottom of the hollow space 46 cause eccentric rotation of the polishing roll 5 or 105, resulting in insufficient polishing of the cereal grains within the polishing chamber 6 and that cereal grains different in variety from each other are mixed with each other. Moreover, the net members 36 or the perforations 134 can bring the hollow space 46 to the state of static pressure, so that air is blown uniformly through the entire meshes of the net members 36 or the entire perforations 134. This makes it possible to avoid lack of uniformity in removal of the dust including the removed surface layers of the cereal grains.

It will be appreciated by one skilled in the art that the polishing roll may be provided with a single vertically extending, elongated slot and a single vertically extending, elongated agitating projection. This is applicable also to second and third embodiments subsequently to be described. In this case, it is needless to say that only a single net member or perforations in a single region is or are required.

Figure 5:
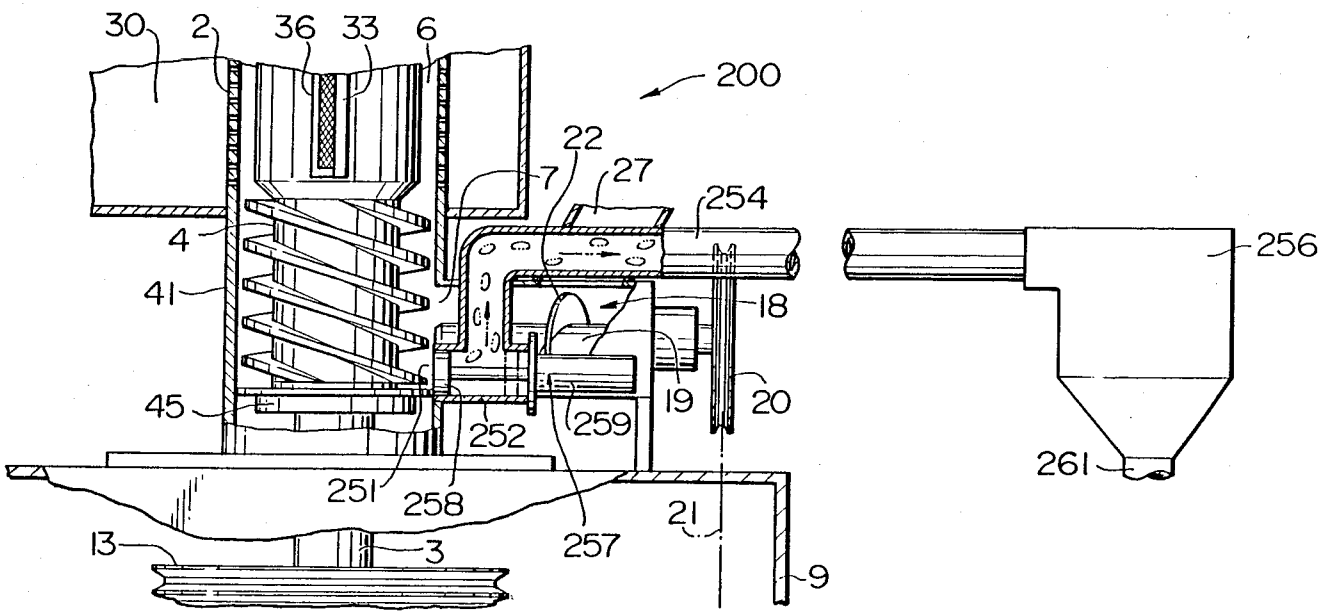
FIG. 5 is a fragmental cross-sectional view of a cereal-grain polishing apparatus according to a second embodiment of the invention, which comprises means for discharging residual cereal grains within the apparatus.

FIG. 5 shows a cereal-grain polishing apparatus, generally designated by the reference numeral 200, according to a second embodiment of the invention. The apparatus 200 is similar in construction to the apparatus 1 shown in FIGS. 1 through 3. In FIG. 5, components and parts the same as those of the apparatus 1 are designated by the same reference numerals, and the description of such same components and parts will therefore be omitted to avoid repetition. The apparatus 200 is different from the apparatus 1 in that the apparatus 200 additionally comprises means for discharging residual cereal grains within the imperforated tubular member 41 after completion of the polishing operation.

Specifically, a discharge port 251 is formed in the peripheral wall of the lower imperforated tubular member 41 at such a location that the lower edge of the discharge port 251 is substantially flush with the rotary disc 45. In this connection, it is to be noted that the discharge port 251 is arranged in circumferentially spaced relation to the supply port 7, though the discharge port 251 is shown in FIG. 5 as being overlapped with the supply port 7 for convenience of illustration. A short duct 252 is connected to the peripheral wall of the lower imperforated tubular member 41 so as to communicate with the discharge opening 251. A long duct 254 has one end thereof connected to an axially intermediate portion of the short duct 252. A blower 256 is connected to the other end of the long duct 254 for drawing air therethrough. A discharge pipe 261 is connected to a discharge port of the blower 256. A valve unit 257 is associated with the short duct 252, and comprises a disc-shaped valve member 258 arranged within the short duct 252 for movement along the axis thereof. The valve member 258 is fixedly mounted to a forward end of a rod of an air cylinder 259 in such a manner that the valve member 258 is movable between a closed position indicated by the solid lines where the discharge port 251 is closed by the valve member 258 and an open position indicated by the phantom lines where the discharge port 251 is opened to communicate with the long duct 254.

When the screw conveyor 18 is stopped in operation after completion of the polishing operation described previously with reference to FIGS. 1 through 3, some cereal grains remain within the polishing chamber 6 and within the space between the screw feed roll 4 and the lower imperforated tubular member 41. While the rotary shaft 3 is maintained rotated, the air cylinder 259 is operated to move the valve member 258 to the open position indicated by the phantom lines, and the blower 256 is operated to draw air through the long duct 254. The residual cereal grains on the rotary disc 45 are caused to successively enter the short duct 252 under the action of the centrifugal force due to rotation of the rotary disc 45. The cereal grains within the short duct 252 are transported under suction by the blower 256 through the long duct 254 and are discharged to the outside of the apparatus 200 through the discharge pipe 261.

According to the second embodiment illustrated in FIG. 5, simple operation of the valve unit 257 enables the residual cereal grains on the rotary disc 45 to be discharged easily, quickly and substantially completely under the action of the centrifugal force due to the rotary disc 45 and under the forcible drawing action due to the blower 256. This makes it possible to avoid that the residual cereal grains are mixed with cereal grains of a different variety newly supplied to the polishing chamber 6 for polishing.

Referring to FIGS. 6 through 10, there is shown a cereal-grain polishing apparatus, generally designated by the reference numeral 300, according to a third embodiment of the invention.

Figure 6:
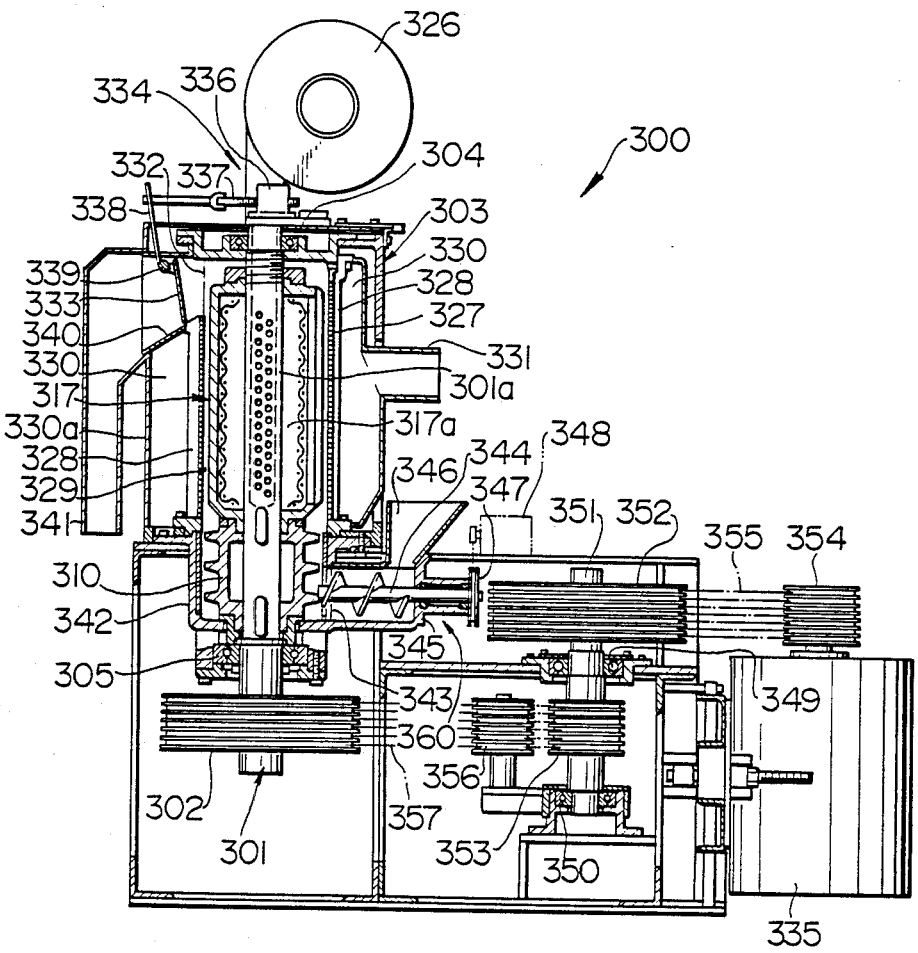
FIG. 6 is a vertical cross-sectional view of a cereal-grain polishing apparatus according to a third embodiment of the invention, in which each of the polishing roll and a screw feed roll can be divided into a plurality of sections.
Figure 7:
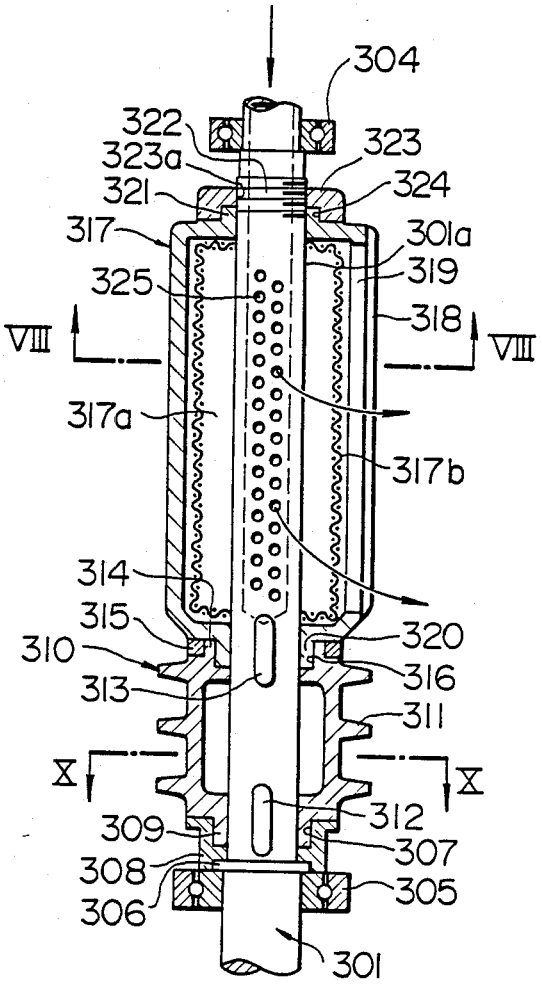
FIG. 7 is a vertical cross-sectional view of the polishing roll and the screw feed roll illustrated in FIG. 6.

As shown in FIGS. 6 and 7, the apparatus 300 comprises a rotary shaft 301 having a hollow upper half section 301*a* and a solid lower half section. A pulley assembly 302 is mounted to a lower end of the rotary shaft 301 for rotation therewith. The rotary shaft 301 is rotatably supported by a pair of upper and lower bearings 304 and 305 mounted to a frame 303. The rotary shaft 301 is formed with a flange 306 at a location adjacent, but above the pulley assembly 302. The flange 306 has a lower face which is abutted against the lower bearing 305 to vertically support the rotary shaft 301. An upper face of the flange 306 serves to support a clutch ring 308 which is formed therein with a fitting recess 307 in the form of a substantially circular truncated cone.

Figure 10:
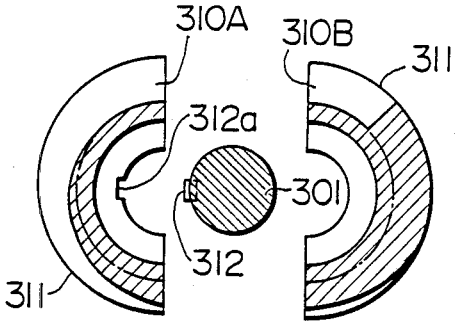
FIG. 10 is an exploded cross-sectional view of the screw feed roll taken along the line X—X in FIG. 7.

A screw feed roll 310 formed at its lower end with a tapered annular fitting projection 309 is arranged above the clutch ring 308. As shown in FIG. 10, the screw feed roll 310 can be divided into two roll sections 310A and 310B. The roll sections 310A and 310B are provided at their respective lower ends with respective semi-circular projecting sections which cooperate with each other to form the tapered annular fitting projection 309 fitted into the fitting recess 307. The roll sections 310A and 310B are provided with threaded sections 311 which form a single thread when the roll sections are assembled together as shown in FIGS. 6 and 7.

As shown in FIG. 7, a key 312 is arranged between the rotary shaft 301, and the lower end wall of the screw feed roll 310 and the clutch ring 308 to prevent them from rotating relatively to the rotary shaft 301. The lower end wall of the roll section 310A is formed therein with a key way 312*a* (see FIG. 10) for the key 312. A key 313 for detent is arranged between the rotary shaft 301 and the upper end wall of the screw feed roll 310. The roll sections 310A and 310B are provided on their respective upper end walls with respective semi-circular projecting sections which cooperate with each other to form an annular projection 314. A clamp ring 315 is fitted about the annular projection 314 to hold the roll sections 310A and 310B together.

Figure 8:
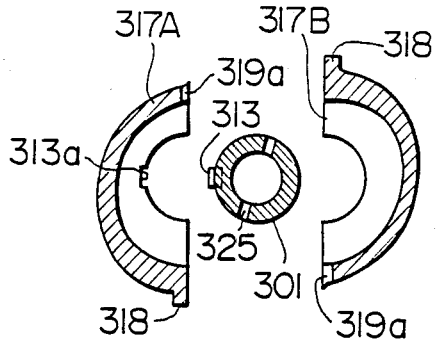
FIG. 8 is an exploded cross-sectional view of the polishing roll taken along the line VIII—VIII in FIG. 7.

The upper end wall of the screw feed roll 310 is formed with a fitting recess 316 in the form of a substantially circular truncated cone. A polishing roll 317 is provided at its lower end wall with a tapered annular fitting projection 320 which can be fitted into the fitting recess 316 to support the polishing roll 317. As shown in FIG. 8, the polishing roll 317 can be divided into two roll sections 317A and 317B. Each of the roll sections 317A and 317B is provided with a vertically extending, elongated agitating projection 318 and a vertically extending, elongated recess 319*a* arranged in substantially diametrically opposed relation to the agitating projection 318. When the roll sections 317A and 317B are assembled together, the elongated recess 319*a* in one of the two roll sections 317A and 317B cooperates with the side edge face of the other roll section adjacent its agitating projection 318, to define an elongated slot 319 as shown in FIG. 7. The roll sections 317A and 317B are formed at their respective lower ends with respective semi-circular projections which cooperate with each other to form the aforesaid annular fitting projection 320 fitted into the fitting recess 316 in the upper end wall of the screw feed roll 310. One of the roll sections 317A is formed in its lower end wall with a key way 313*a* into which the above-mentioned key 313 is fitted to prevent rotation of the polishing roll 317 relative to the rotary shaft 301.

The roll sections 317A and 317B are provided at their respective upper end walls with respective semi-circular fitting projection which cooperate with each other to form an annular fitting projection 321 as shown in FIG. 7. A retainer ring 323 has a female thread 323*a* which is threadedly engaged with a male thread 322 formed on a portion of the rotary shaft 301 adjacent its upper end. The retainer ring 323 is provided in its lower face with a fitting recess 324. The retainer ring 323 is threadedly engaged with the male thread 322 and is tightened such that the fitting projection 321 on the upper end wall of the polishing roll 317 is fitted into the fitting recess 324 in the retainer ring 323. The retainer ring 323 is further tightened to urge the polishing roll 317 and the screw feed roll 310 against the clutch ring 308, thereby assembling them together firmly on the rotary shaft 301.

The polishing roll 317 is hollow, and an annular hollow space 317*a* is defined between the peripheral wall of the polishing roll 317 and the rotary shaft 301. A plurality of through bores 325 are formed in the peripheral wall of a portion of the upper hollow section 301*a* of the rotary shaft 301, which portion is surrounded by the polishing roll 317. Thus, the hollow portion of the upper hollow section 301*a* communicates with the hollow space 317*a* through the through bores 325. A blower 326 is connected to the upper end of the rotary shaft 301 to blow air into the hollow portion of the upper hollow section 301*a*.

A wire net member 317*b* is arranged within the hollow space 317*a*, and has a cylindrical wall and opposite end walls. The cylindrical wall of the wire net member 317*b* covers the elongated slots 319 in the polishing roll 317 to prevent cereal grains from entering the hollow space 317*a* through the elongated slots 319.

Figure 9:
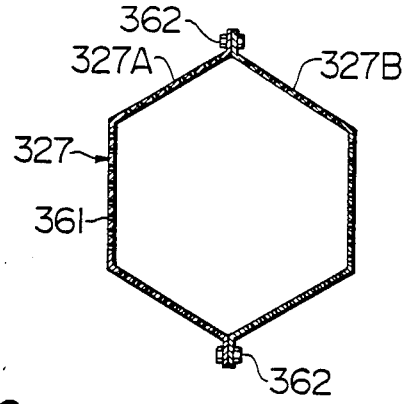
FIG. 9 is a horizontal cross-sectional view of the perforated tubular member illustrated in FIG. 6.

As shown in FIG. 6, a perforated tubular member 327 is arranged about the polishing roll 317. The perforated tubular member 327 is formed therein with a plurality of perforations 361 regularly spaced from each other as shown in FIG. 9. The perforated tubular member 327 may have a polygonal cross-sectional shape, but usually has a hexagonal cross-sectional shape in case where the polishing roll 317 is provided with a pair of elongated agitating projections 318. The perforated tubular member 327 can divided into two perforated sections 327A and 327B as seen from FIG. 9, which are assembled together by means of a plurality of bolt/nut assemblies 362.

Referring back to FIG. 6, the perforated tubular member 327 is reinforced by a plurality of circumferentially spaced elongated retainers 328. An annular polishing chamber 329 is defined between the polishing roll 317 and the perforated tubular member 327. A duct 330*a* is arranged to surround the perforated tubular member 327 to define therebetween a surrounding space 330 which communicates with a dust collecting unit such as a cyclone collector or the like arranged on the outside of the apparatus 300.

The polishing chamber 329 has an upper end portion which communicates with a discharge port 332. Associated with the discharge port 332 is a pressure plate 333 connected to an automatic pressure adjusting mechanism 334 for regulating the cereal grains discharged through the discharge port 332. The pressure adjusting mechanism 334 comprises a reversible motor 336 having incorporated therein a linear head. A threaded shaft 337 is threadedly engaged with the linear head of the reversible motor 336 for reciprocative movement horizontally along an axis of the threaded shaft 337. A lever 338 formed of elastic material has one end thereof which is connected to a forward end of the threaded shaft 337. The other end of the lever 338 is mounted to a pivot 339 for angular movement therewith about an axis of the pivot 339. The pressure plate 333 is also mounted to the pivot 339 for angular movement therewith. An electric current value is set in a main electric motor 335 for rotatively driving the rotary shaft 301, by manipulation of an operating panel (not shown). The reversible motor 336 is designed to move the pressure plate 333 angularly about the axis of the pivot 339 toward and away from the discharge port 332 such that the current supplied to the main motor 335 is maintained constant. A flow-down chute 340 is provided which is connected to the discharge port 332. A discharge chute 341 is connected to the flow-down chute 340.

A cup-shaped member 342 is arranged below the perforated tubular member 327. The cup-shaped member 342 has a cylindrical peripheral wall serving as an imperforated tubular member, and a substantially closed bottom wall. The screw feed roll 310 is rotatably accommodated in the cup-shaped member 342. The peripheral wall of the cup-shaped member 342 is formed with a supply port 343 at a location adjacent the closed bottom wall. A screw conveyor 360 comprises a casing 345 connected to the supply port 343. A supply screw 344 is accommodated in the casing 345. A supply hopper 346 is connected to an end of the casing 345 remote from the supply port 343. A pulley 347 is fixedly mounted to an end of a shaft of the supply screw 344, and is connected, through a belt, to a pulley which is fixedly mounted to an output shaft of an electric motor 348.

A transmission mechanism from the main motor 335 to the rotary shaft pulley assembly 302 will next be described. An intermediate shaft 351 arranged vertically is rotatably supported by a pair of upper and lower bearings 349 and 350. A pulley assembly 352 is mounted to an upper portion of the intermediate shaft 351 for rotation therewith. A pulley assembly 353 is also mounted to a portion of the intermediate shaft 351 between the upper and lower bearings 349 and 350, for rotation with the intermediate shaft 351. The pulley assembly 352 is connected, through a V-belt assembly 355, to a pulley assembly 354 which is mounted to an output shaft of the main motor 33 for rotation therewith. The pulley assembly 353 is connected to the rotary shaft pulley assembly 302 through a V-belt assembly 357 and through a tension pulley assembly 356.

The operation of the cereal-grain polishing apparatus 300 constructed above will be described below.

Operating buttons on the operating panel (not shown) are first manipulated to start the main motor 335, and to turn on the motor 388 to drive the feed screw 344 within the casing 345. Moreover, an electric current value is set in the main motor 335*b* by the automatic pressure adjusting mechanism 334. Rotational force of the main motor 335 is transmitted to the intermediate shaft 351 through the pulley assembly 352, and is in turn transmitted to the rotary shaft pulley assembly 302 through the pulley assembly 353, thereby rotating the rotary shaft 301 as well as the screw feed roll 310 and the polishing roll 317. Thus, the running preparation is completed.

After the running preparation has been completed, cereal grains to be polish are fed into the supply hopper 346 from a stoner or the like through a chute (not shown). The cereal grains within the supply hopper 346 are forcibly fed into the cup-shaped member 342 through the supply port 343 by the supply screw 344. The cereal grains within the cup-shaped member 342 are fed upwardly into the polishing chamber 329 by the rotating screw feed roll 310. The cereal grains fed into the polishing chamber 329 are agitated by the elongated agitating projections 318 on the rotating polishing roll 317. The cereal grains are brought into friction contact with each other under high pressure, and the polishing proceeds. That is, the cereal grains within the polishing chamber 329 are subjected to pressure from the pressure plate 333 at the discharge port 332, and are subjected to pressure due to the cereal grains fed successively by the screw feed roll 310. The own weights of the respective cereal grains within an upper portion of the polishing chamber 329 are also applied to the cereal grains within a lower portion of the polishing chamber 329. Thus, the internal pressure within the polishing chamber 329 is brought to an adequate high value, making it possible to carry out the polishing action smoothly.

The cereal grains after having been polished are pushed up by the cereal grains fed upwardly by the screw feed roll 310, and are discharged through the discharge port 332 against the pressure plate 333. The cereal grains discharged through the discharge port 332 are guided to the outside of the apparatus 300 by the flow-down chute 340 and the discharge chute 341. On the other hand, a dust including removed surface layers of the cereal grains generated within the polishing chamber 329 is carried by air blown through the elongated slots 319, out of the polishing chamber 329 to the surrounding space 330 through the perforations 361 in the perforated tubular member 327. The dust within the surrounding space 330 is transported to the outside of the apparatus 300 through the duct 331 by a blower arranged at the dust collecting unit (not shown).

The above is the steady running. If the polishing roll 317 and the screw feed roll 310 are worn away by the use for a long period of time, the agitating action and the upward feeding action are weaken so that the cereal grains are not polished in an excellent manner. In this case, it is required to replace the polishing roll 317 and the screw feed roll 310 with new ones. The replacement will be described. A cover 330*a* for the surrounding space 330 is first opened. The cover 330*a* is so formed as to be capable of being opened by a hinge arrangement or the like. The elongated retainers 328 are detached from the frame 303. The bolt/nut assemblies 362 are removed from the perforated tubular member 327 to disassemble the same into the perforated sections 327A and 327B, thereby exposing a part of the polishing roll 317 and a part of the screw feed roll 310. Subsequently, the retainer ring 323 is loosened to disengage the fitting recess 324 in the retainer ring 323 from the fitting projection 321 on the upper end wall of the polishing roll 317. Then, the fitting projection 320 on the lower end wall of the polishing roll 317 is disengaged from the fitting recess 316 in the upper end of the screw feed roll 310, to disassemble the polishing roll 317 into the two roll sections 317A and 317B as shown in FIG. 8. The disassembled roll sections 317A and 317B are detached from the rotary shaft 301.

Subsequently, the clamp ring 315 is removed from the annular projection 314 on the upper end wall of the screw feed roll 310. Then, the fitting projection 309 on the lower end wall of the screw feed roll 310 is disengaged from the fitting recess 307 in the clutch ring 308. The screw feed roll 310 is moved slightly upwardly and is disassembled into the roll sections 310A and 310B as shown in FIG. 10. Thus, the roll sections 310A and 310B are detached from the rotary shaft 301.

A new polishing roll 317 and a new screw feed roll 310 are attached to the rotary shaft 301 in a manner reverse to that described above. That is, the semi-circular projecting sections on the lower ends of the respective roll sections 310A and 310B are fitted into the fitting recess 307 in the clutch ring 308, and are assembled together in such a manner that the key 312 fitted in the key wa in the rotary shaft 301 is fitted into the key way 312*a* in the roll section 310A. The clamp ring 315 is fitted about the annular projection 314 formed by the projecting sections on the upper end walls of the respective roll sections 310A and 310B. Thus, the roll section 310A and 310B are assembled into the screw feed roll 310. Subsequently, the semicircular projecting sections on the lower ends of the respective roll sections 317A and 317B are fitted into the fitting recess 316 in the upper end wall of the screw feed roll 310 in such a manner that the key 313 is fitted in the key wa 313*a* in the roll section 317A. The semi-circular projecting sections on the upper end walls of the respective roll sections 317A and 317B are fitted into the fitting recess 324 in the retainer ring 323. Thus, the roll sections 317A and 317B are assembled into the polishing roll 317. The retainer ring 323 is tightened about the male thread 322 on the rotary shaft 301, to mount the screw feed roll 310 and the polishing roll 317 onto the rotary shaft 301. In this manner, the replacement is completed.

Figure 11:
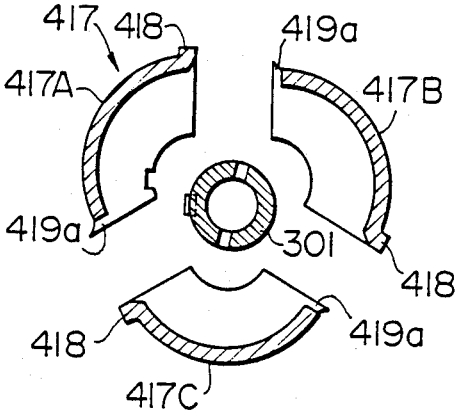
FIG. 11 is a view similar to FIG. 8, but showing a modification of the polishing roll.

FIG. 11 shows a modification of the polishing roll illustrated in FIGS. 6 through 8. The polishing roll 417 according to the modification can be divided into three roll sections 417A, 417B and 417C each having an angular extent of 120 degrees. Each of the roll sections 417A, 417B and 417C is provided with a vertically extending, elongated agitating projection 418 and a vertically extending, elongated recess 419*a* arranged respectively along the opposite side edges of the roll section. When the roll sections 417A, 417B and 417C are assembled together, the elongated recess 419*a* in one of the three roll sections cooperates with the side edge face of the adjacent roll section to define an elongated slot similar to the elongated slot 319 shown in FIG. 7.

Figure 12:
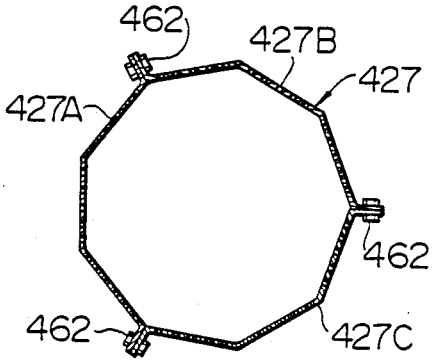
FIG. 12 is a view similar to FIG. 9, but showing a modification of the perforated tubular member.

FIG. 12 shows a modification of the perforated tubular member illustrated in FIGS. 6 and 9. The perforated tubular member 427 according to the modification has an octagonal cross-sectional shape in a plane perpendicular to an axis of the perforated tubular member 427. The perforated tubular member 427 is suitable for use with the polishing roll 417 provided with the three circumferentially spaced elongated agitating projections 419 shown in FIG. 11. The perforated tubular member 427 can be divided into three perforated sections 427A, 427B and 427C each extending along the axis of the perforated tubular member 427. The three perforated sections 427A, 427B and 427C are assembled together into the perforated tubular member 427 by means of a plurality of bolt/nut assemblies 462.

As described above, the arrangement of the third embodiment and the modifications thereof shown respectively in FIGS. 6 through 10 and FIGS. 11 and 12 is such that each of the polishing roll 317, 417 and the screw feed roll 310 can be divided into a plurality of sections each extending along the axis of the rotary shaft 301. With such arrangement, when the screw feed roll 310 and the polishing roll 317, 417 are worn away and are required to be replaced with new ones, division of each of the screw feed roll 310 and the polishing roll 317, 417 into the plurality of sections facilitates mounting and demounting of these rolls to and from the rotary shaft 301. Thus, such cumbersome or troublesome operation can be dispensed with that the upper bearing section about the rotary shaft is disassembled, and then the screw feed roll and the polishing roll are drawn upwardly out of the rotary shaft.

What is claimed is:

1. A cereal-grain polishing apparatus comprising:

a perforated tubular member arranged to have an axis extending substantially vertically;

a rotary shaft rotatably arranged within said perforated tubular member and having an axis substantially coincident with the axis of said perforated tubular member;

drive means for rotatively driving said rotary shaft;

a polishing roll arranged within said perforated tubular member and mounted on said rotary shaft for rotation therewith, said polishing roll having a peripheral wall extending in substantially concentric relation to the axis of said rotary shaft, said peripheral wall having an outer surface which cooperates with said perforated tubular member to define therebetween a polishing chamber, said peripheral wall having an inner surface which cooperates with an outer peripheral surface of said rotary shaft to define therebetween a hollow space said polishing roll being provided in said peripheral wall with opening means through which said hollow space communicates with said polishing chamber, said polishing roll being further provided on said peripheral wall with agitating projection means projecting from the outer surface of said peripheral wall;

a screw feed roll mounted on said rotary shaft for rotation therewith, at a location below said polishing roll;

supply means for forcibly supplying cereal grains to be polished, to a supply position at said screw feed roll, wherein when said polishing roll and said screw feed roll are rotated together with said rotary shaft by said drive means, said screw feed roll feeds the cereal grains supplied to said supply position by said supply means, into said polishing chamber thereby causing the cereal grains to move upwardly toward an upper end of said polishing chamber through the same, and said agitating projection means on said polishing roll agitates the cereal grains within said polishing chamber to bring the cereal grains into friction contact with each other, thereby removing surface layers from the respective cereal grains to polish the same; and air-flow means for causing air to flow from said hollow space to a surrounding space around an outer peripheral surface of said perforated tubular member, through said opening means, said polishing chamber and perforations in said perforated tubular member, to carry the removed surface layers out of said polishing chamber to said surrounding space, wherein said opening means in said polishing roll is formed by a plurality of apertures smaller in size than the cereal grains to prevent the same from entering said hollow space from said polishing chamber.

2. A cereal-grain polishing apparatus according to claim 1, wherein said polishing roll is formed in its peripheral wall with at least one vertically extending, elongated slot through which said hollow space communicates with said polishing chamber, and said polishing roll further includes at least one net member serving as a part of said peripheral wall, said net member being mounted to said peripheral wall to cover said elongated slot, and wherein said apertures of said opening means in said polishing roll are formed by a plurality of meshes of said net member.

3. A cereal-grain polishing apparatus according to claim 2, wherein said agitating projection means has at least one vertically extending, elongated agitating projection, and wherein said elongated slot is located just behind said elongated agitating projection with reference to a rotational direction of said polishing roll.

4. A cereal-grain polishing apparatus according to claim 1, wherein said apertures of said opening means in said polishing roll are formed by a plurality of perforations provided in said peripheral wall.

5. A cereal-grain polishing apparatus according to claim 4, wherein said perforations in said peripheral wall are provided in at least one vertically extending, elongated region of said peripheral wall.

6. A cereal-grain polishing apparatus according to claim 1, wherein said air-flow means comprises a duct assembly surrounding said perforated tubular member to define said surrounding space around the outer peripheral surface of said perforated tubular member, and a blower connected to said duct assembly for drawing air to cause the air to flow from said hollow space to said surrounding space through said apertures, said polishing chamber and the perforations in said perforated tubular member.

7. A cereal-grain polishing apparatus according to claim 6, wherein said rotary shaft is hollow and is provided in its peripheral wall with a plurality of through bores, the hollow portion of said rotary shaft communicating with said hollow space through said through bores.

8. A cereal-grain polishing apparatus according to claim 1, wherein said supply means comprises a screw conveyer whose shaft has an axis extending substantially horizontally.

9. A cereal-grain polishing apparatus according to claim 1, further comprising an imperforated tubular member arranged in coaxial relation to said perforated tubular member and having an upper end connected to a lower end of said perforated tubular member, said screw feed roll being arranged substantially within said imperforated tubular member, said imperforated tubular member is formed in its peripheral wall with a supply port, said supply means forcibly supplying the cereal grains to be polished, to said supply position through said supply port.

10. A cereal-grain polishing apparatus according to claim 9, further comprising discharge means for discharging residual cereal grains within said imperforated tubular member after completion of the polishing operation, said discharge means including a rotary disc mounted, adjacent a lower end of said screw feed roll, on said rotary shaft for rotation therewith, a discharge port formed in the peripheral wall of said imperforated tubular member at a level of said rotary disc, a duct having one end thereof connected to said discharge port, a blower connected to the other end of said duct for drawing air therethrough, and valve means movable between a closed position where said valve means closes said discharge port and an open position where said valve means opens said discharge port.

11. A cereal-grain polishing apparatus according to claim 1, wherein said rotary shaft is hollow and is provided in its peripheral wall with a plurality of through bores, the hollow portion of said rotary shaft communicating with said hollow space through said through bores, and wherein said air-flow means comprises a blower connected to the hollow portion of said rotary shaft for blowing air into the hollow portion of said rotary shaft to cause the air to flow from the hollow portion of said rotary shaft to said surrounding space through said hollow space, said apertures of said opening means in said polishing roll, said polishing chamber and the perforations in said perforated tubular member.

12. A cereal-grain polishing apparatus according to claim 1, wherein said screw feed roll can be divided into a plurality of roll sections each extending along an axis of said screw feed roll, and wherein said polishing roll can be divided into a plurality of roll sections each extending along an axis of said polishing roll.

13. A cereal-grain polishing apparatus according to claim 12, wherein said perforated tubular member can be divided into a plurality of perforated sections each extending along an axis of said perforated tubular member.

14. A cereal-grain polishing apparatus according to claim 12, wherein said polishing roll is formed in its peripheral wall with a plurality of vertically extending, elongated slots arranged in peripherally spaced relation to each other, said hollow space communicating with said polishing chamber through said elongated slots, wherein said polishing roll further includes a net member arranged within said hollow space to cover said elongated slots, and wherein said apertures of said opening means in said polishing roll are formed by a plurality of meshes of said net member.

* * * * *

UNITED STATES PATENT AND TRADEMARK OFFICE

CERTIFICATE OF CORRECTION

PATENT NO. : 4,829,893

DATED : May 16, 1989

INVENTOR(S) : Toshihiko SATAKE

It is certified that error appears in the above-identified patent and that said Letters Patent is hereby corrected as shown below:

Col. 2, line 18, change "o" to --of--;

Col. 4, line 17, change "ar" to --are--;

Col. 10. line 46, change "projection" to --projections--;

Col. 12, line 23, change "33" to --335--;

Col. 12, line 31, change "388" to --348--;

Col. 12, line 43, change "polish" to --polished--;

Col. 13, line 56, change "wa" to --way--; and

Col. 13, line 66, change "wa" to --way--.

Signed and Sealed this

Thirteenth Day of March, 1990

*Attest:*

JEFFREY M. SAMUELS

*Attesting Officer*

*Acting Commissioner of Patents and Trademarks*